350-319 SR
10/4/77 XR 4,052,608

United States Patent [19]

Papenmeier

[11] 4,052,608

[45] Oct. 4, 1977

[54] INSPECTION GLASS LIGHT

[76] Inventor: Horst Papenmeier, Talweg 2, 584, Schwerte, Germany

[21] Appl. No.: 656,197

[22] Filed: Feb. 9, 1976

[30] Foreign Application Priority Data

Feb. 13, 1975 Germany ..... 2506084

[51] Int. Cl.[2] ..... F21L 1/00

[52] U.S. Cl. ..... 362/368; 73/293; 350/319; 362/154

[58] Field of Search ..... 240/2.18, 5, 11.2 R, 240/11.2 E, 12; 34/88; 126/200; 220/82 R; 73/293, 328, 330, 331, 334; 350/319

[56] References Cited

U.S. PATENT DOCUMENTS

| | | | |
|---|---|---|---|
| 1,991,192 | 2/1935 | Bucky | 73/293 X |
| 3,331,959 | 7/1967 | Sayre et al. | 240/11.2 R |

FOREIGN PATENT DOCUMENTS

| | | | |
|---|---|---|---|
| 871,925 | 2/1953 | Germany | 240/11.2 E |
| 1,147,903 | 5/1963 | Germany | 240/2.18 |

*Primary Examiner*—John Gonzales
*Attorney, Agent, or Firm*—Strauch, Nolan, Neale, Nies & Kurz

[57] ABSTRACT

The present invention relates to an inspection glass light for the illumination and simultaneous observation of working operations in closed spaces having a lamp housing, an intermediate housing having a viewing window with the intermediate housing being mounted on a flange of an observation chamber.

6 Claims, 1 Drawing Figure

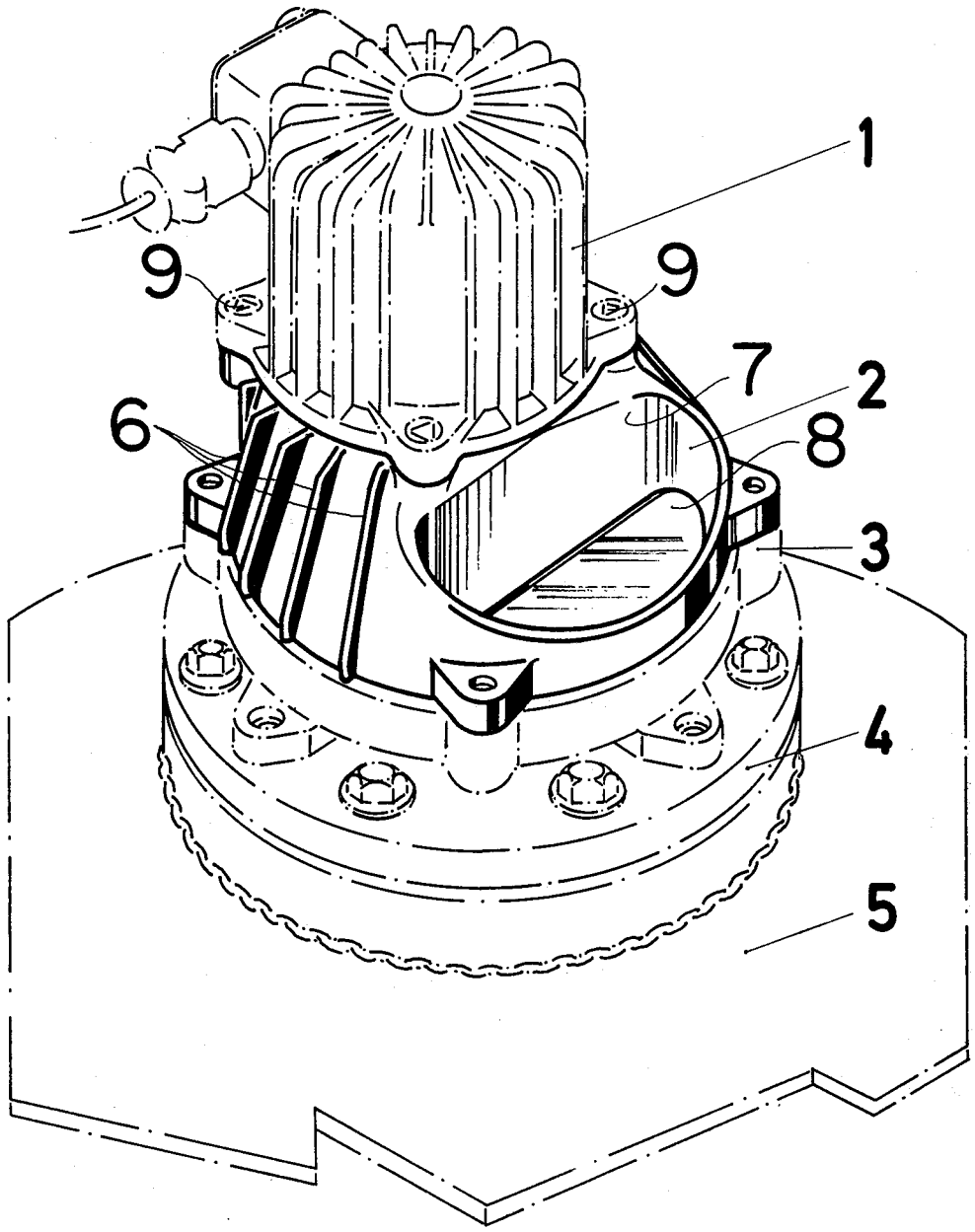
1
9
9
7
2
6
8
3
4
5

INSPECTION GLASS LIGHT

PRIOR ART

An inspection glass light is shown in German Pat. No. 1,147,903. It is screwed to an inspection glass flange mount of conventional type which is welded into the wall of a boiler or similar apparatus. The inspection glass light which opens towards the light outlet side is hermetically sealed by means of the interposition of a sealing element and a glass sheet or pane built into the inspection glass flange mount; this being accomplished at the time when the inspection glass light is placed or screwed on the inspection glass flange mount.

A very great disadvantage of these known constructional forms is that the higher standards of protection, such as an explosion-proof and pressure-encapsulated arrangement, cannot be provided in a rational and economical manner.

A further disadvantage is that an inspection glass light with a corresponding flange diameter must be stocked for each flange diameter size. Although by standardising the number of flange diameters it is possible to limit this to some extent, nevertheless it would be desirable if one were required to stock but a single inspection glass light size for a range of different flange diameters. Naturally this is not possible in previously known constructions.

SUMMARY OF INVENTION

The present invention is directed to an integrated unit type construction which overcomes the above disadvantages; one which provides even higher protective standards such as needed, for example, in an explosion-proof and pressure-encapsulated arrangement, and which permits more rational and economical manufacture of such inspection glass lights.

This is achieved according to the invention in that the housing is constructed of a lamp housing and a transition or intermediate housing which is also situated between the lamp housing and the flange and in which the viewing window is located.

The lamp housing and the intermediate housing are connected detachable with each other. The flange diameter of the lamp housing is advantageously so selected that the lamp housing matches one of the known standardised flange mounts for the illumination of closed containers, apparatus and the like, and also matches as many intermediate housings as possible which are constructed as light and viewing ducts.

The invention makes it possible to allow a lamp housing of given size to be used for at least a certain number of different inspection glass flange mount diameters, the intermediate housing taking over the task of effecting the necessary adaption. Therefore, in individual cases this intermediate housing can be given a cylindrical or substantially conical shape; that is to say it can widen from the connecting flange facing towards the lamp housing in the direction towards the flange which faces towards the cover flange of the inspection glass flange mount.

DESCRIPTION OF THE DRAWING

The invention will be explained in detail hereinafter with reference to a constructional example shown in the drawing. The drawing shows an inspection glass light according to the present invention secured to a container wall 5. The light comprises a lamp housing 1 which is bolted to an intermediate housing 2 which is constructed as a combination light and viewing duct. The intermediate housing 2 in the present case has a substantially frustoconical shape. It is provided with ribs 6 which are used for giving stability and for discharging in a more satisfactory manner the heat which is developed by the incandescent lamp provided in the lamp not shown housing 1. Constructed in the intermediate housing 2 is the viewing window 7 which, because of the special arrangement in conjunction with the light issuing from the lamp housing 1, allows the operations being carried out to be observed from the same place as that from which these operations are illuminated.

The intermediate housing 2 in this case is bolted to the glass folder ring 3 with the inclusion of a sheet of glass 8; the bolts have not been shown in the drawing. The block flange 4 itself is welded to the housing wall.

The main advantage of the known inspection glass lights which were previously discussed is regarded as being that they have the shape of but a segment or a sector of a circle and do not substantially reduce the viewing diameter or increase the external diameter of the complete arrangement, but rather allow the rays of light and the direction in which the observer views the working operations to be situated parallel and adjacent to one another. These advantages are retained in the present inventive arrangement; but also the present invention affords the further advantage of more rational manufacture, since a single lamp housing size can be used for different diameters of the inspection glass flange mount.

A further advantage is that simple conventional inspection glass lights without viewing windows can now be developed to constitute viewing glass lights with viewing windows even with the higher types of protection, so that only a viewing glass flange mount in the boiler or apparatus wall is required for illuminating and observing working operations in installations requiring explosion protection.

In order to allow access to the incandescent lamp, which is not shown here, in the lamp housing 1 in order to allow the lamp to be replaced when necessary, it is advantageous if the connections 9 between the lamp housing 1 and the intermediate housing 2 are releasable.

What is claimed and desired to be secured by Letters Patent is:

1. A combination inspection glass light assembly for simultaneous illumination and observation, adapted to be mounted on an inspection glass flange of an observation chamber, comprising: an intermediate housing including side-by-side ducts through said housing from one end to the other end, one duct constituting a light duct and the other duct constituting a viewing duct, one end of said intermediate housing having a mounting flange surrounding the associated ends of both ducts and providing means for mounting said intermediate housing on an inspection glass flange, the other end of said housing having a connecting flange portion surrounding only the associated other end of said light duct; lamp means including a housing having a mounting flange; means connecting said lamp housing mounting flange to said connecting flange; and the other end of said viewing duct adjacent said lamp housing constituting a viewing window.

2. A combination inspecting glass light assembly according to claim 4, wherein the outer contour of said intermediate housing between its end has a substantially frustoconical shape.

3. A combination inspection glass light assembly according to claim 2, wherein said means connecting said lamp housing to said intermediate housing constitutes a releasable connection means.

4. For use in a combined inspection glass light assembly for simultaneous illumination and observation which is adapted to be mounted on an inspection glass flange of an observation chamber, an intermediate adaptor housing including side-by-side ducts through said housing from one end to the other end, one duct constituting a light duct and the other duct constituting a viewing duct, one end of said intermediate housing having a mounting flange surrounding the associated ends of both ducts and providing means for mounting said intermediate housing on an inspection glass flange, the other end of said housing having a connecting flange portion surrounding only the associated other end of said light duct and on which a lamp housing can be mounted; means on said connecting flange enabling releasable connection adjacent said connecting flange constituting a viewing window.

5. An intermediate adaptor housing according to claim 4 wherein the outer contour of said housing between its end has a substantially frustoconical shape.

6. An intermediate adaptor housing according to claim 4 wherein the external contour of said housing includes ribs between said ends at least adjacent the portion including the light duct.

* * * * *

UNITED STATES PATENT OFFICE

CERTIFICATE OF CORRECTION

Patent No. 4,052,608 Dated October 4, 1977

Inventor(s) Horst Papenmeier

It is certified that error appears in the above-identified patent and that said Letters Patent are hereby corrected as shown below:

Column 1, line 40, delete "also".

Column 1, line 42, after "is" insert --also--.

Column 2, line 8, "not shown" should be in parentheses.

Column 2, claim "2", line 67, change "4" to --1-- (our error).

Column 4, line 5, after line 5, after "connection" insert --of a lamp housing; and the other end of said viewing duct--.

Signed and Sealed this

*Seventh* Day of *February 1978*

[SEAL]

*Attest:*

RUTH C. MASON
*Attesting Officer*

LUTRELLE F. PARKER
*Acting Commissioner of Patents and Trademarks*